US006024231A

United States Patent [19]

Bates

[11] Patent Number: 6,024,231

[45] Date of Patent: Feb. 15, 2000

[54] RETRACTABLE TOWEL BAR

[76] Inventor: Atwood Bates, 2602 Chasewood Ct., Aurora, Ill. 60504

[21] Appl. No.: 09/156,462

[22] Filed: Sep. 18, 1998

[51] Int. Cl.[7] ..... A47H 1/02

[52] U.S. Cl. ..... 211/105.1

[58] Field of Search ..... 211/105.1, 105.2, 211/123, 16, 6, 7, 119.009

[56] References Cited

U.S. PATENT DOCUMENTS

| | | | |
|---|---|---|---|
| 1,019,662 | 3/1912 | Kroder . | |
| 1,259,247 | 3/1918 | Lamey . | |
| 1,733,970 | 10/1929 | Koering . | |
| 2,447,908 | 8/1948 | Hoots . | |
| 2,473,771 | 6/1949 | Slater . | |
| 2,542,163 | 2/1951 | Swalwell | 211/123 |
| 2,554,446 | 5/1951 | Nestor . | |
| 3,527,352 | 9/1970 | De Lapa . | |
| 3,756,679 | 9/1973 | Schoenfelder . | |
| 4,729,482 | 3/1988 | Nicholson . | |
| 5,335,759 | 8/1994 | Yeh . | |

*Primary Examiner*—Alvin Chin-Shue
*Assistant Examiner*—Sarah Purol
*Attorney, Agent, or Firm*—Banner & Witcoff, Ltd.

[57] ABSTRACT

A retractable towel bar apparatus including an anchoring base for attachment to a flat surface and a retractable towel bar that can slide between open and closed positions through sleeves in the anchoring base that extend through the surface to which the anchoring base is attached.

14 Claims, 10 Drawing Sheets

RETRACTABLE TOWEL BAR

BACKGROUND OF THE INVENTION

1. Field of the Invention

In general, this invention relates to towel bars, and more particularly to a retractable towel bar and anchoring base.

2. Statement of Related Art

Conventional, non-retractable towel bars are typically very limited in terms of where they can be mounted for practical purposes. Such towel bars often require disproportionately large areas on a wall or other flat surface for mounting and often constitute an obstruction when mounted in confined spaces.

It is therefore an object of this invention to provide a retractable towel bar and anchoring base that can be mounted to a relatively small area on a flat surface and that will be retractable substantially flush to the flat surface, such that no obstruction is created when the towel bar is in its retracted or closed position.

SUMMARY OF THE INVENTION

This invention is a retractable towel bar comprising a transverse elongated run, and first and second perpendicular runs attached to respective ends of the transverse elongated run, with the first and second perpendicularly attached runs slidably positioned within first and second sleeves of an anchoring base. The anchoring base is adapted to be mounted on a flat surface. The anchoring base defines first and second sleeves for extension through holes in the flat surface. The sleeves preferably have barbed tips on the outer surfaces of the sleeves. The barbed sleeves prevent the anchoring base from being unintentionally removed from the flat surface. The sleeves also contain axial ribs to reduce friction during sliding of the towel bar through the sleeves. The anchoring base also preferably includes first and second recesses to allow the transverse elongated run of the towel bar to be retracted substantially adjacent to the anchoring base. The anchoring base also preferably includes a recess in the anchoring base for facilitating grasping of the transverse run of the retractable towel bar when the towel bar is fully retracted substantially adjacent to the anchoring base.

DETAILED DESCRIPTION

Figure 1:
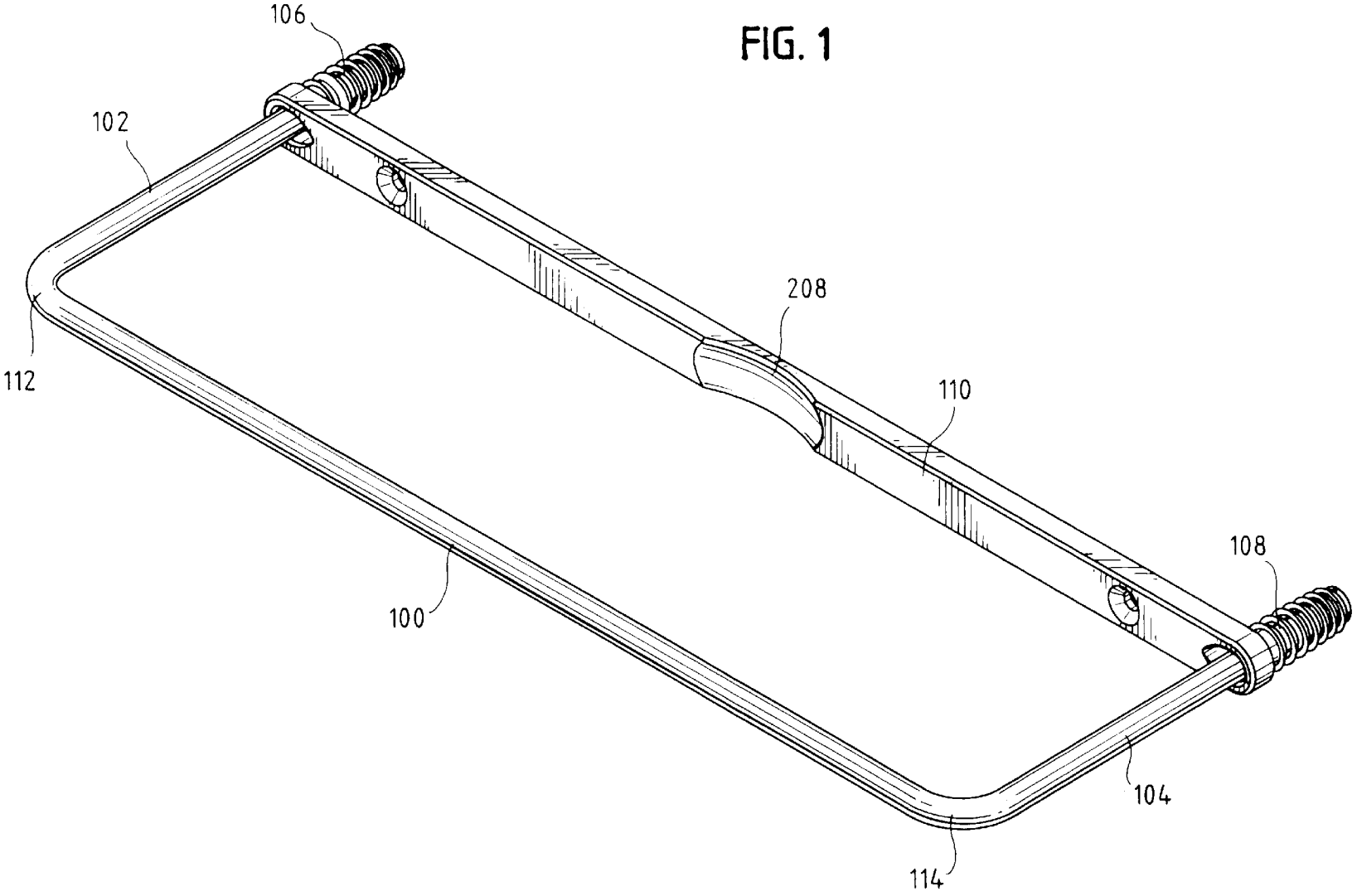
FIG. 1 is a perspective view of the preferred embodiment of this invention showing the retractable towel bar slidably positioned within the first and second sleeves of the anchoring base.

FIG. 1 is a perspective view of the preferred embodiment of this invention. Transverse elongated run 100, first run 102, and second run 104 are shown with first run 102 and second run 104 inserted through first sleeve 106 and second sleeve 108 of anchoring base 110.

Anchoring base 110 is adapted for attachment to virtually any flat surface. Anchoring base 110 defines first sleeve 106 and second sleeve 108, which are adapted to receive first run 102 and second run 104. First sleeve 106 and second sleeve 108 typically will extend perpendicularly through the flat surface that anchoring base 110 is attached to.

First run 102 and second run 104 are perpendicularly attached to first curved end 112 and second curved end 114, respectively, of transverse run 100. First run 102 and second run 104 are slidably positioned within first sleeve 106 and second sleeve 108, respectively, to allow transverse run 100 to be slidably positioned relative to anchoring brace 110. As a result, transverse run 100 may be pulled away from the anchoring base into an open position, as shown in FIG. 1, or moved into a closed position adjacent to anchoring brace 110, or any desired position between the open and closed positions.

Figure 2:
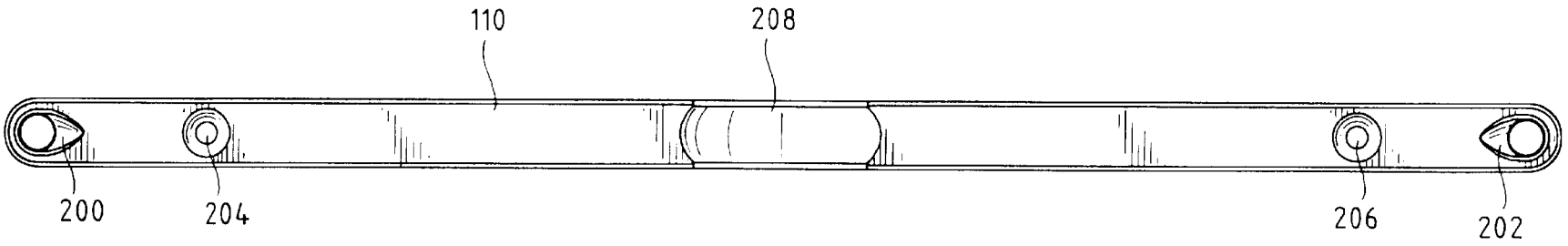
FIG. 2 is a front view of the anchoring base.

FIG. 2 is a front view of anchoring brace 110. First recess 200 and second recess 202 are shown. The recesses allow first run 102 and second run 104 to slide more fully into first sleeve 106 and second sleeve 108 than would otherwise be possible absent first recess 200 and second recess 202 by providing curved recesses adapted to receive first curved end 112 and second curved end 114. As a result, transverse run 100 can be positioned adjacent anchoring base 110.

FIG. 2 also shows recess 208, which is also shown in perspective view in FIG. 1. Recess 208 provides space for an individual to insert his or her fingers between transverse run 100 and anchoring base 110 to facilitate moving transverse run 100 away from the closed or retracted position. FIG. 2 also shows recessed screw holes 204 and 206, which are adapted to receive a screw with a tapered head for attaching the anchoring base to a flat surface.

Anchoring base 110 may be made of clear acrylic plastic. As will be apparent to those skilled in the art, other suitable materials may also be used. The retractable towel bar, which comprises transverse elongated run 100, first and second runs 102 and 104, and first and second curved ends 112 and 114, may be made of coated metal. As will be apparent to those skilled in the art, other suitable materials could also be used. The combination of coated metal for the retractable towel bar and clear acrylic plastic for the anchoring base results in significant cost savings over known prior art towel bar constructions.

Figure 3:
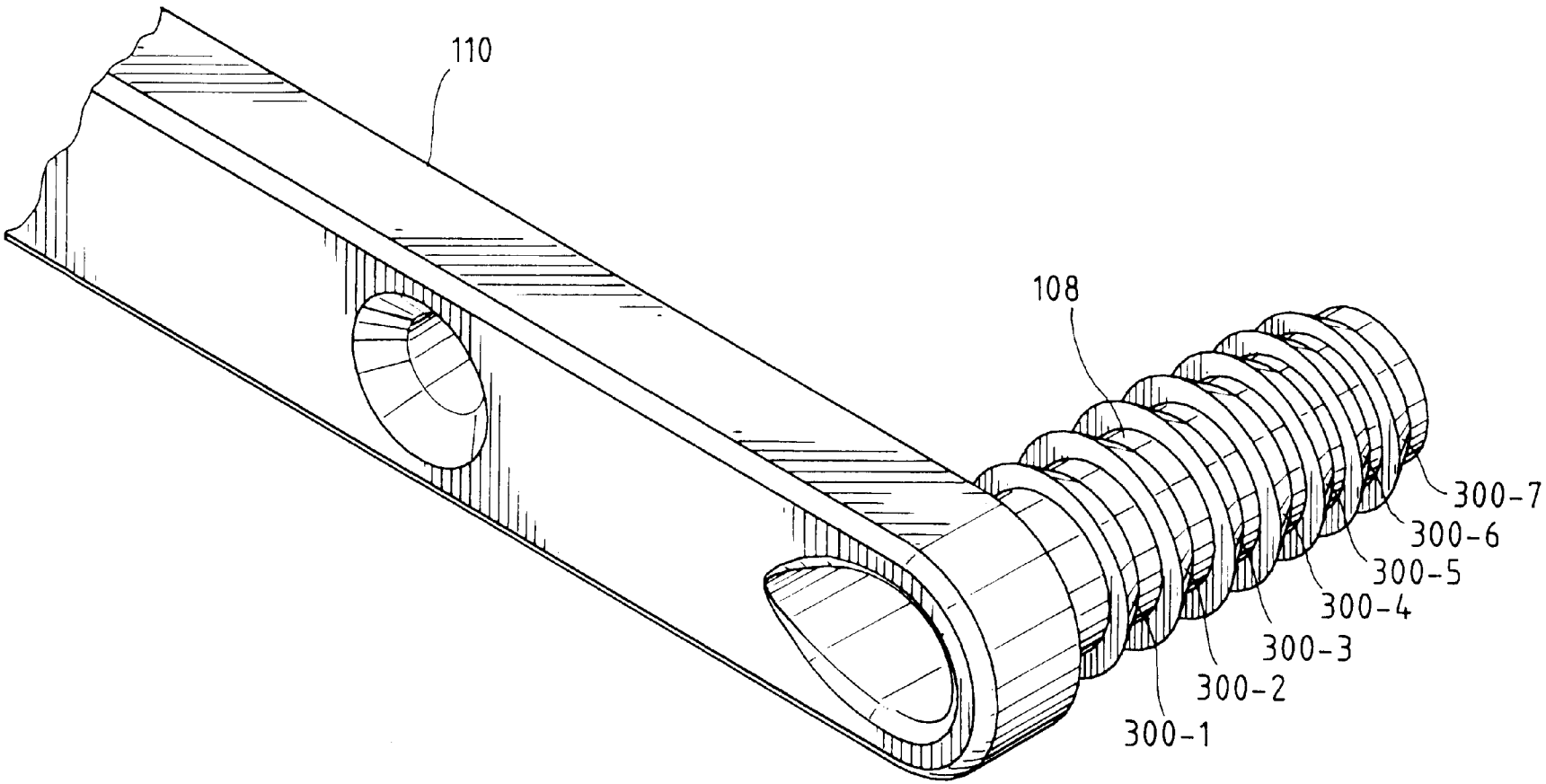
FIG. 3 is a perspective view of one of the sleeves of the anchoring base including the barbed tips on the outside surface of the sleeve.

FIG. 3 is an enlarged view of second sleeve 108. FIG. 3 depicts barbed tips 300-1 through 300-7 ("collectively 300"). Barbed tips 300 are adapted to grip interior surfaces of first and second holes (not shown) extending through the surface to which the anchoring base is attached. The tapering of barbed tips 300 in the direction in which second sleeve 108 is inserted through a hole in the surface to which anchoring base 110 is attached helps prevent anchoring base 110 from being unintentionally pulled away from the surface.

Figure 4:
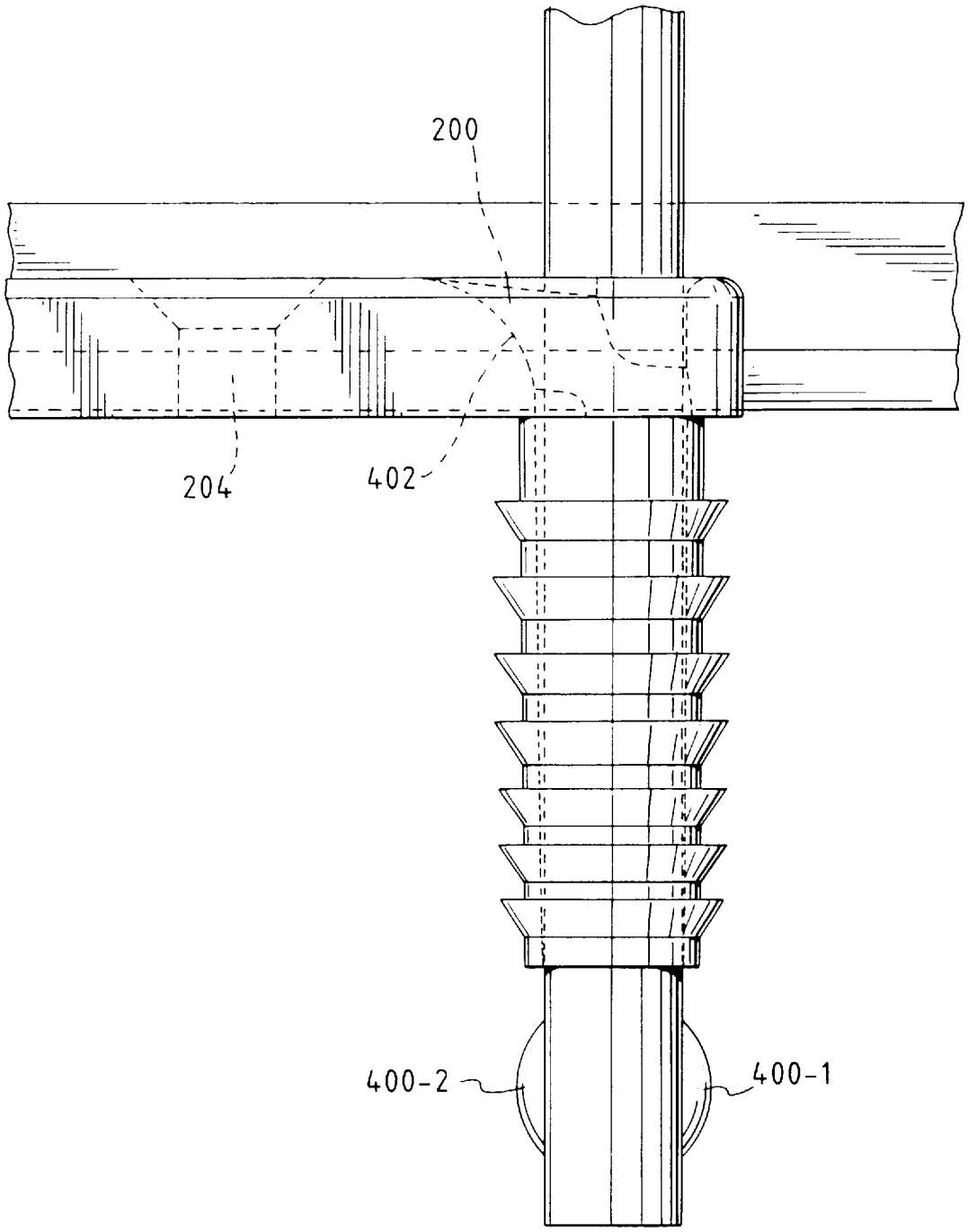
FIG. 4 is a top view of a perpendicular run of the retractable towel bar slidably positioned within a sleeve of the anchoring base.

FIG. 4 shows knibs 400-1 and 400-2 which may be pressed or stamped onto first and second runs 102 and 104 after those runs have been inserted into sleeves 106 and 108. Knibs 400 prevent first and second runs 102 and 104 from sliding completely out of sleeves 106 and 108. It will be apparent to those skilled in the art that other means for preventing runs 102 and 104 from sliding completely through sleeves 106 and 108 could also be used without departing from the scope of this invention.

FIG. 4 also depicts from a top view a curved portion 402 of recess 200. The curved portion 402 allows first end 112 of transverse run 100 to be inserted more fully into anchoring base 110, thereby allowing transverse run 100 to be fully retracted adjacent to anchoring base 110, as previously described. FIG. 4 also shows a top view of recessed screw hole 204.

Figure 5:
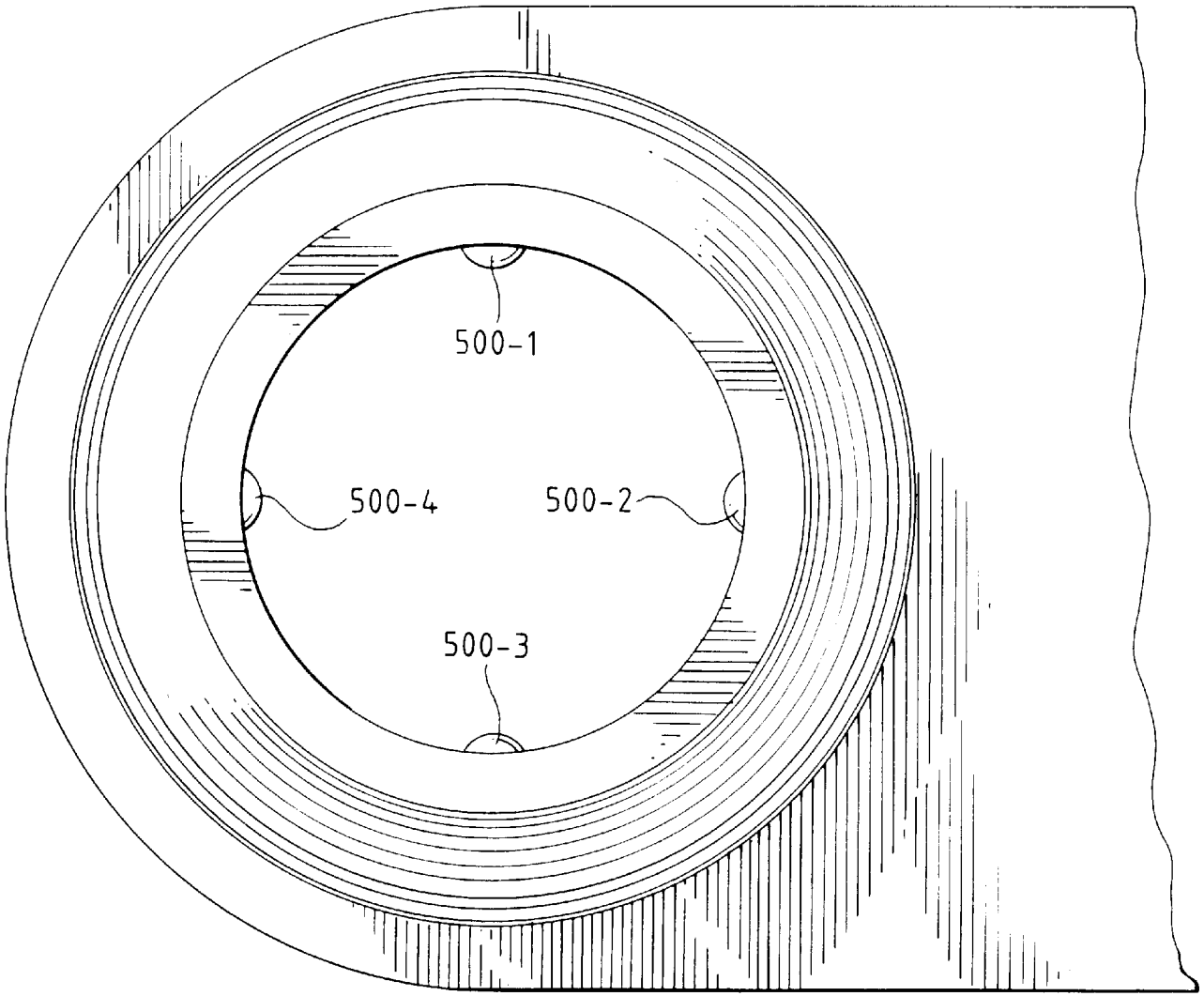
FIG. 5 is a front view of one of the sleeves of the anchoring base depicting the axial friction ribs located within the sleeve.
Figure 6:
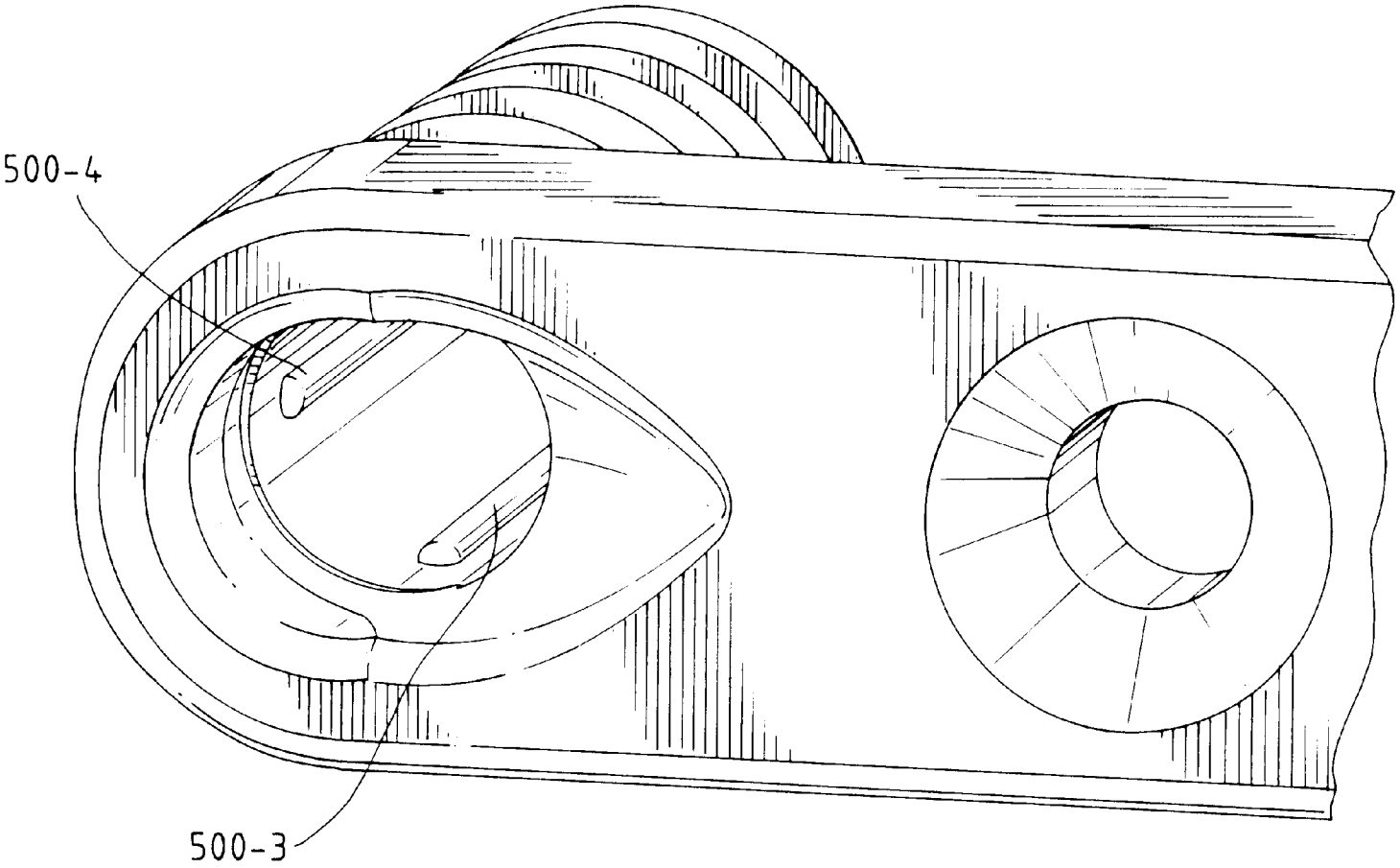
FIG. 6 is a perspective view of the first sleeve, including two axial friction ribs and a tapered hole adapted to receive a screw with a tapered head for mounting the anchoring brace.

FIG. 5 shows a front view of axial ribs 500-1 through 500-4 that reduce friction between first run 102 and first sleeves 106, while first run 102 is sliding within first sleeve 106. Of course, second sleeve 108 may contain similar axial friction ribs. Axial friction ribs 500-3 and 500-4 are shown in perspective view in FIG. 6.

Figure 7:
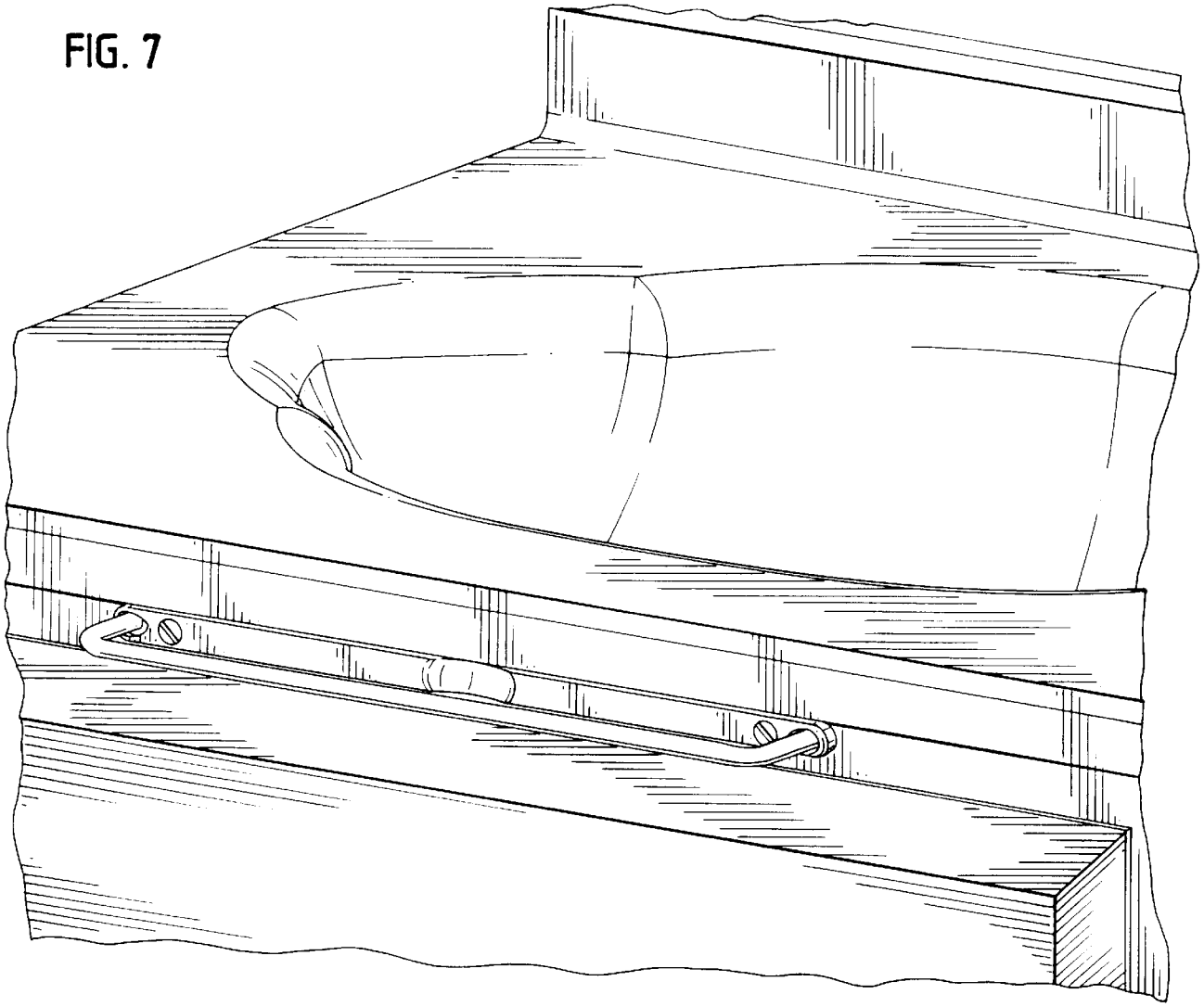
FIG. 7 shows the preferred embodiment of this invention mounted underneath a bathroom sink.
Figure 8:
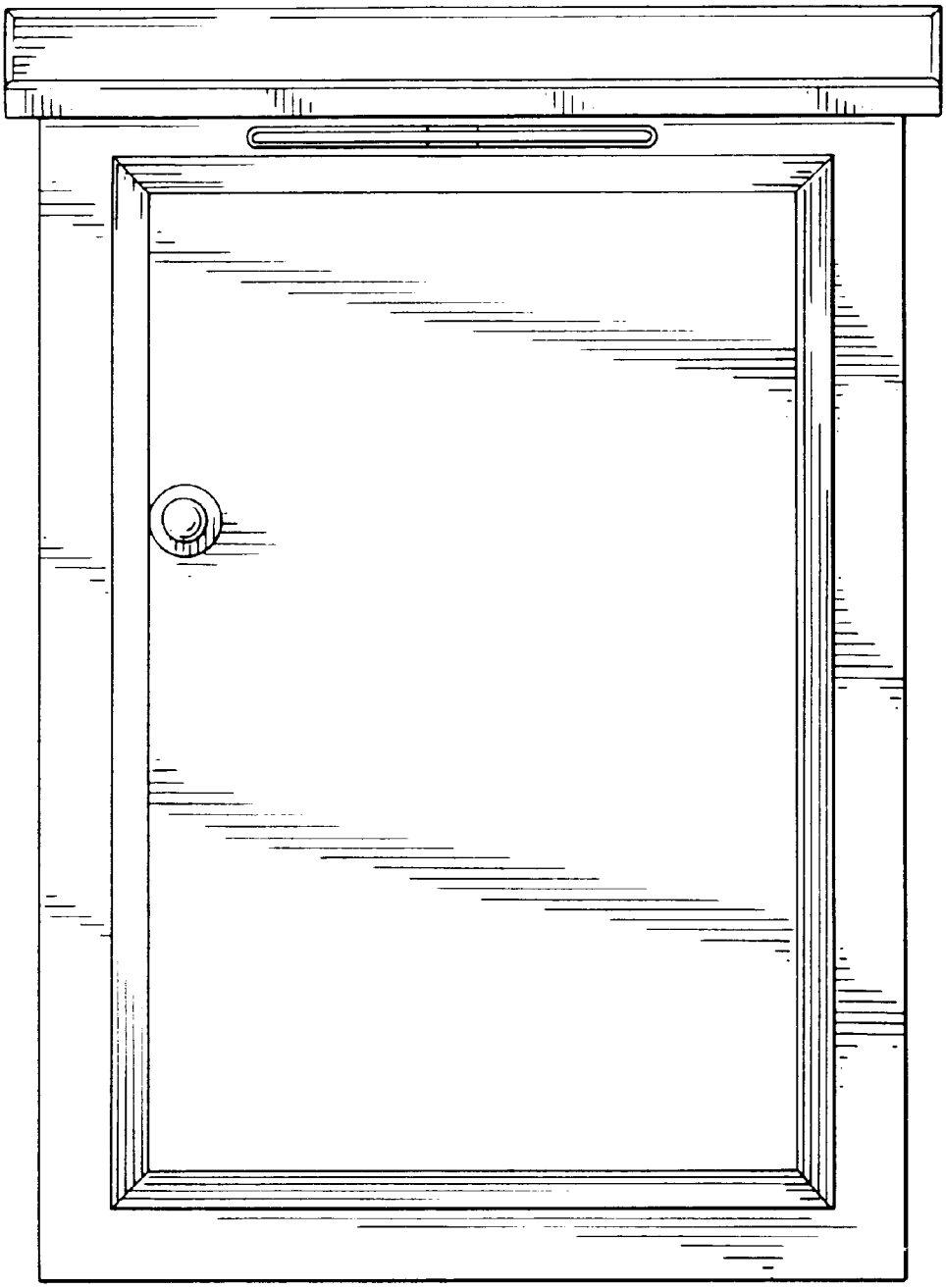
FIG. 8 shows the preferred embodiment of this invention mounted above a cabinet.
Figure 9:
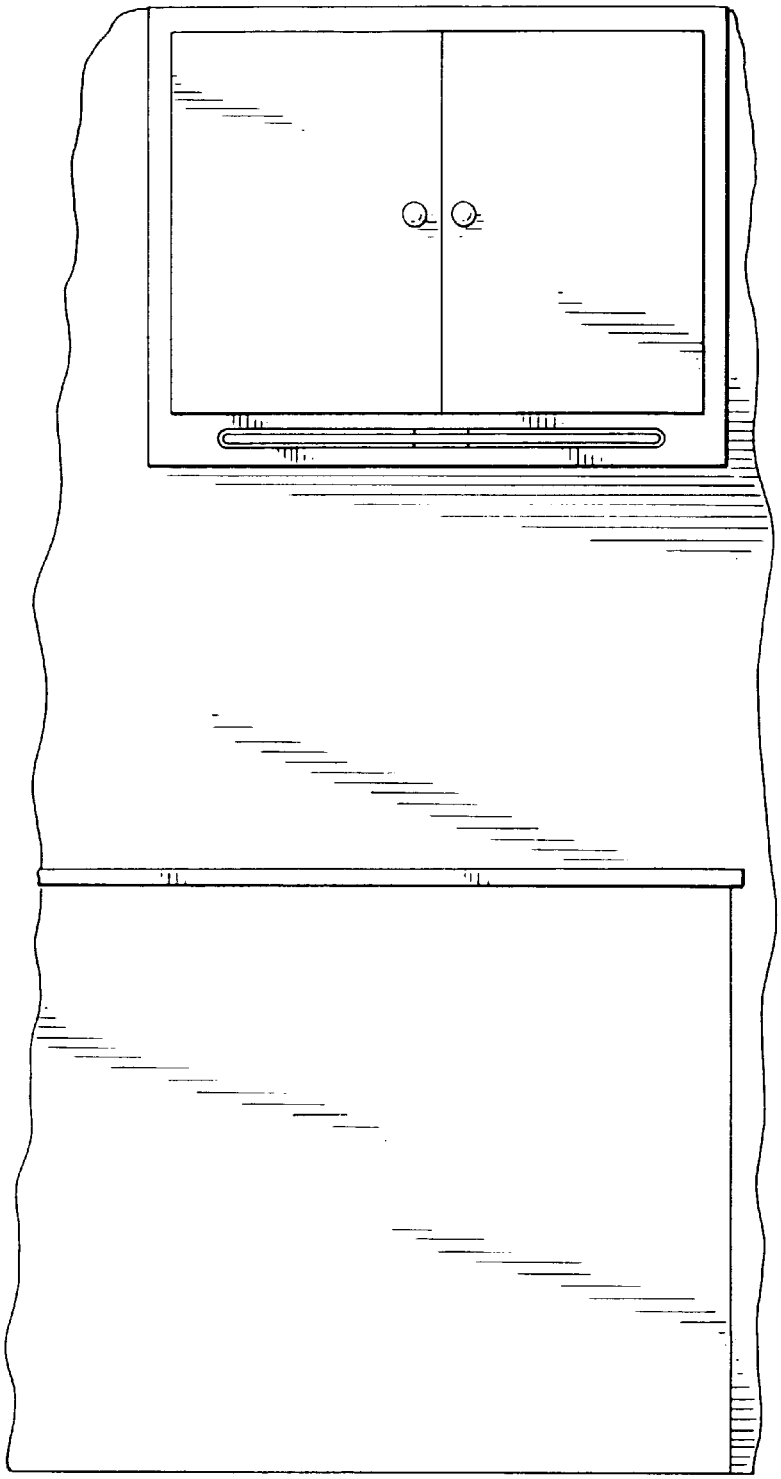
FIG. 9 shows the preferred embodiment mounted underneath a cabinet.

FIG. 7 shows the preferred embodiment of this invention mounted underneath a bathroom sink. FIG. 8 shows the preferred embodiment of this invention mounted above a cabinet. FIG. 9 shows the preferred embodiment mounted underneath a cabinet. As will be apparent to those skilled in the art, a retractable towel bar according to this invention may be mounted in areas unsuitable for mounting conventional prior art towel bars, such as cavities under overhead cupboards, false drawers under most sinks, and the like.

Figure 10:
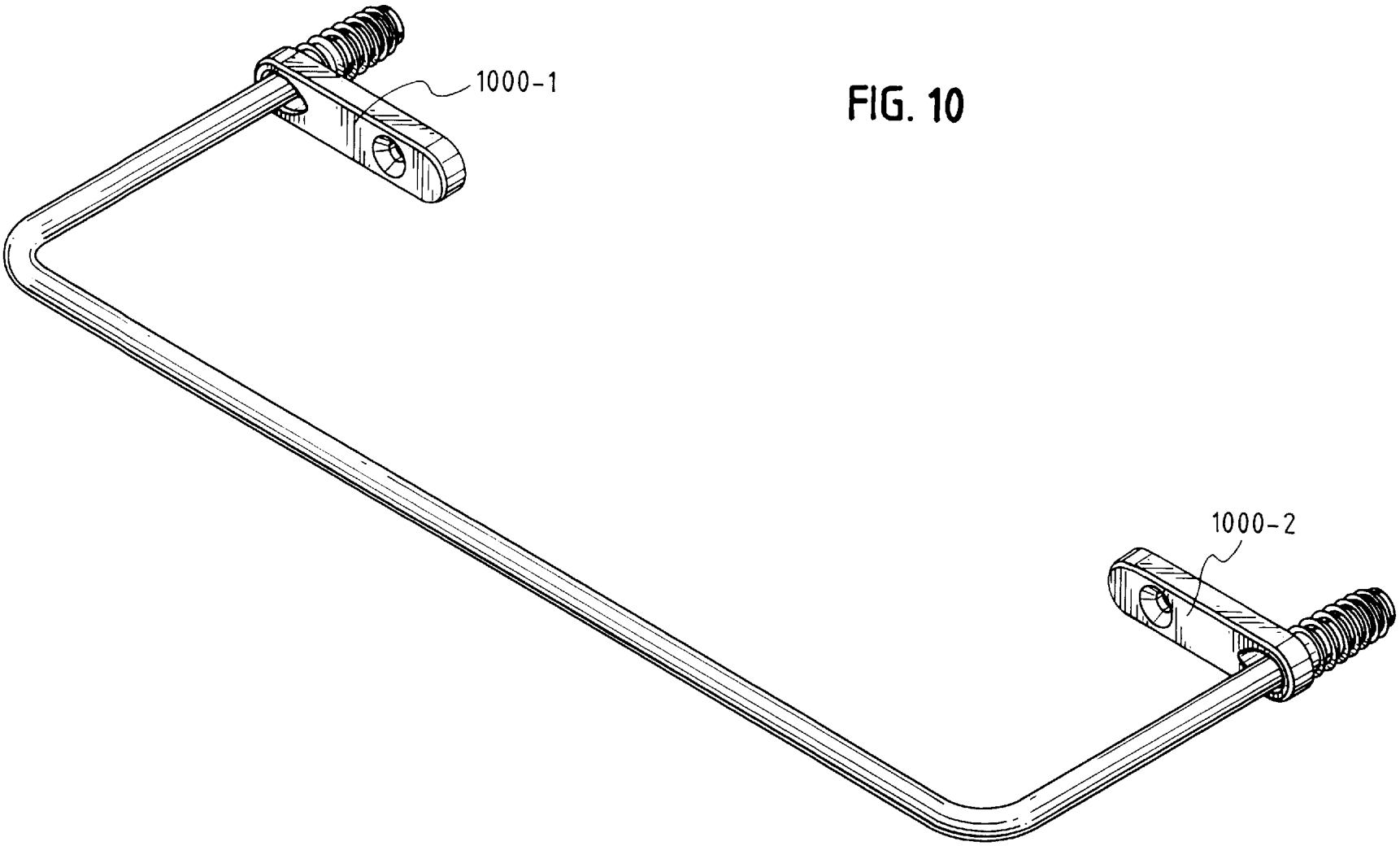
FIG. 10 depicts an alternate embodiment of this invention wherein the anchoring base is comprised of two separate anchoring brackets.

FIG. 10 depicts an alternate embodiment of the anchoring base wherein anchoring brackets 1000-1 and 1000-2 are separate and contain features described in connection with anchoring brace 110.

I claim:

1. A retractable towel bar apparatus, comprising:

a. an anchoring base for attachment to a substantially planar surface, the anchoring base defining a first sleeve and a second sleeve extending substantially perpendicularly through the surface;

b. a retractable towel bar comprising:

i. a transverse elongated run, ii. a first run perpendicularly attached to a first curved end of the transverse run and slidably positioned within the first sleeve, and iii. a second run perpendicularly attached to a second curved end of the transverse run and slidably positioned within the second sleeve such that the transverse elongated run can be slidably positioned substantially adjacent to the planar surface by sliding the first run and the second run fully into the first sleeve and the second sleeve, respectively.

2. The apparatus as in claim 1, wherein the anchoring base comprises:

a. a first anchoring bracket defining the first sleeve; and b. a second anchoring bracket separate from the first anchoring bracket, the second anchoring bracket defining the second sleeve.

3. The apparatus as in claim 1, wherein the outer surfaces of the first and second sleeves comprise barbed tips for gripping respective interior surfaces of a first and a second hole extending through the surface to prevent the anchoring base from being unintentionally disengaged from the surface.

4. The apparatus as in claim 3 wherein the first and second sleeves comprise a plurality of axial ribs for reducing friction between the first and second runs of the retractable towel bar and the first and second sleeves, respectively, while the first and second runs are sliding within the first and second sleeves.

5. The apparatus as in claim 4 wherein the anchoring base comprises first and second recesses for allowing the transverse run of the retractable towel bar to be positioned substantially adjacent to the anchoring base.

6. The apparatus as in claim 5 further comprising a recess between the first and second sleeves for facilitating grasping of the transverse run of the retractable towel bar when the towel bar is fully retracted substantially adjacent to the anchoring base.

7. The apparatus as in claim 6 further comprising means for preventing the first and second runs from sliding out of the first and second sleeves.

8. The retractable bar apparatus as in claim 7, wherein the anchoring base is made of clear acrylic plastic.

9. The apparatus as in claim 8 wherein the anchoring bracket comprises a recessed screw hole adapted to receive a screw with a tapered head for attaching the anchoring base to the surface.

10. The apparatus as in claim 1 wherein the first and second sleeves comprise a plurality of axial ribs for reducing friction between the first and second runs of the retractable towel bar and the first and second sleeves, respectively, while the first and second runs are sliding within the first and second sleeves.

11. The apparatus as in claim 1 wherein the anchoring base comprises first and second recesses for allowing the transverse run of the retractable towel bar to be positioned substantially adjacent to the anchoring base.

12. The apparatus as in claim 1 further comprising a recess between the first and second sleeves for facilitating grasping of the transverse run of the retractable towel bar when the towel bar is fully retracted substantially adjacent to the anchoring base.

13. The apparatus as in claim 1 further comprising knibs for preventing the first and second runs from sliding out of the first and second sleeves, the knibs being attached to respective ends of the first and second runs of the towel bar opposite said respective ends of said first and second runs that are attached to the transverse run.

14. The apparatus as in claim 1 further comprising means for preventing the first and second runs from sliding out of the first and second sleeves.

* * * * *